US009743819B2

(12) United States Patent
Davidshofer

(10) Patent No.: US 9,743,819 B2
(45) Date of Patent: Aug. 29, 2017

(54) FLOOR MOP WITH CONCENTRATED CLEANING FEATURE

(71) Applicant: MIDEA AMERICA CORPORATION, Parsippany, NJ (US)

(72) Inventor: Donald Joseph Davidshofer, Mount Holly, NC (US)

(73) Assignee: MIDEA AMERICA, CORP., Parsippany, NJ (US)

( * ) Notice: Subject to any disclaimer, the term of this patent is extended or adjusted under 35 U.S.C. 154(b) by 541 days.

(21) Appl. No.: 14/035,472

(22) Filed: Sep. 24, 2013

(65) Prior Publication Data

US 2015/0082566 A1 Mar. 26, 2015

(51) Int. Cl.

| | |
|---|---|
| ***A47L 13/12*** | (2006.01) |
| ***A47L 13/22*** | (2006.01) |
| ***A47L 13/42*** | (2006.01) |

(52) U.S. Cl.

CPC ..... *A47L 13/22* (2013.01); *A47L 13/12* (2013.01); *A47L 13/42* (2013.01)

(58) Field of Classification Search

CPC ..... A47L 13/12; A47L 13/22; A47L 13/42
See application file for complete search history.

(56) References Cited

U.S. PATENT DOCUMENTS

| | | | |
|---|---|---|---|
| 1,563,829 | A | 12/1925 | Brown |
| 2,205,535 | A | 6/1940 | Muckenhirn |
| 2,310,011 | A | 2/1943 | Cave et al. |
| 2,469,060 | A | 5/1949 | Vosbikian et al. |
| 2,678,458 | A | 5/1954 | Vosbikian et al. |
| 2,764,774 | A | 10/1956 | Belsky et al. |
| 2,804,638 | A | 9/1957 | Vosbikian et al. |
| 3,006,668 | A | 10/1961 | Stewart |
| 3,050,762 | A | 8/1962 | Ballinger |

(Continued)

FOREIGN PATENT DOCUMENTS

| | | |
|---|---|---|
| DE | 19908259 | 8/2000 |
| EP | 0426209 | 5/1991 |

(Continued)

OTHER PUBLICATIONS

Photographs of Dirt Devil Products publicly available before Sep. 24, 2013, 6 pages.

(Continued)

*Primary Examiner* — Randall Chin
(74) *Attorney, Agent, or Firm* — Hodgson Russ LLP

(57) ABSTRACT

A mop having a base plate, a handle, a joint connecting the plate to the handle, a first grip at the end of the handle, a scrubbing mechanism in the base, and a cleaning pad attached to the bottom of the base. The scrubbing mechanism includes a scrub bar, and is movable between an inactive position in which the bar is flush with or above the lower surface of the plate, and an active position in which the bar extends through an opening through the plate to be at least partially below the lower surface of the plate. The cleaning pad moves from being flat on the lower surface of the plate when the scrubbing mechanism is in the inactive position, and a second configuration in which at least a portion of the cleaning pad protrudes downwards from the lower surface when the scrubbing mechanism is in the active position.

16 Claims, 7 Drawing Sheets

(56) References Cited

U.S. PATENT DOCUMENTS 3,362,037 A 1/1968 Griffin
3,395,415 A 8/1968 Leland
3,440,677 A 4/1969 Flomerfelt
3,484,171 A * 12/1969 Rosendall ..... A47L 13/22 401/206
3,656,202 A 4/1972 Paton
3,720,974 A 3/1973 Rosendall
3,792,505 A 2/1974 Saltzstein
3,850,533 A 11/1974 Thielen
4,031,673 A 6/1977 Hagelberg
4,068,340 A 1/1978 Forward
4,127,911 A 12/1978 Cupp
4,165,550 A 8/1979 Burke
4,219,899 A 9/1980 Zurawin et al.
4,299,262 A 11/1981 Andrepont
4,327,459 A 5/1982 Gilbert
4,392,269 A 7/1983 Nishiyama et al.
4,433,451 A 2/1984 Parisi
4,658,461 A 4/1987 Roe et al.
4,845,800 A 7/1989 Pederson et al.
4,852,210 A * 8/1989 Krajicek ..... A47L 13/20 15/144.2
4,858,962 A 8/1989 Bolling
4,864,675 A 9/1989 Jones
4,926,515 A 5/1990 Lynn et al.
5,067,400 A 11/1991 Bezella et al.
5,133,101 A 7/1992 Hauser et al.
5,232,298 A 8/1993 Mitsunari
5,323,506 A 6/1994 Babitch
5,341,541 A 8/1994 Sham
5,377,378 A 1/1995 Cutler
5,386,612 A 2/1995 Sham
5,502,872 A 4/1996 Chae
5,581,839 A 12/1996 Ferrell, Jr.
5,584,091 A 12/1996 Borofsky
5,591,507 A 1/1997 Jones
5,613,271 A 3/1997 Thomas
5,625,918 A 5/1997 Kieson et al.
5,876,141 A 3/1999 Hsu
5,881,423 A 3/1999 Shumway et al.
5,887,314 A 3/1999 Jordan, Jr.
5,888,006 A 3/1999 Ping
5,901,402 A 5/1999 Williams
5,920,952 A 7/1999 Baldacci
5,988,920 A 11/1999 Kunkler et al.
6,003,191 A 12/1999 Sherry et al.
6,087,279 A 7/2000 Laun
6,101,661 A 8/2000 Policicchio et al.
6,119,298 A 9/2000 Kenmochi
6,148,144 A 11/2000 Milanese
6,289,551 B1 9/2001 Basile
6,305,046 B1 10/2001 Kingry et al.
6,336,240 B1 1/2002 Laux et al.
6,397,427 B1 6/2002 Bryngelsson
6,453,506 B1 9/2002 Sumner
6,463,620 B2 10/2002 Busha
6,487,746 B1 12/2002 Cioci
6,502,275 B1 1/2003 Hsieh
6,540,424 B1 4/2003 Hall et al.
6,546,584 B2 4/2003 Hobden
6,571,421 B1 6/2003 Sham et al.
6,579,023 B2 6/2003 Kunkler
6,584,990 B2 7/2003 Shaw
6,591,442 B2 7/2003 Kaminstein
6,606,757 B2 8/2003 Vosbikian et al.
6,640,383 B2 11/2003 Tsen
6,663,306 B2 12/2003 Policicchio
6,669,391 B2 12/2003 Policicchio
6,692,172 B1 2/2004 Hsu
6,716,805 B1 4/2004 Sherry et al.
6,722,806 B2 4/2004 Kunkler
6,814,519 B2 11/2004 Policicchio
6,820,301 B2 11/2004 Petner
6,823,559 B2 11/2004 Kaffenberger
6,836,921 B1 1/2005 Petner
6,842,936 B2 1/2005 Policicchio et al.
6,854,911 B2 2/2005 Policicchio
6,871,372 B2 3/2005 Vosbikian et al.
6,889,917 B2 5/2005 Fahy et al.
6,892,415 B2 5/2005 Libman et al.
6,893,180 B2 5/2005 Hall
6,899,485 B2 5/2005 Hall
6,910,823 B2 6/2005 Policicchio
6,934,995 B2 8/2005 Wheeler
6,948,873 B2 9/2005 Policicchio
6,953,299 B2 10/2005 Wang et al.
6,964,535 B2 11/2005 Bell
6,976,802 B2 12/2005 Hall
6,986,618 B2 1/2006 Hall
6,990,708 B2 1/2006 Rosa
7,007,338 B2 3/2006 Garabedian, Jr. et al.
7,028,364 B2 4/2006 Policicchio
7,033,965 B2 4/2006 Takabayashi et al.
7,048,804 B2 5/2006 Kisela
7,055,204 B2 6/2006 Ajluni
7,059,011 B2 6/2006 Capitani
7,096,531 B2 8/2006 Policicchio
7,124,464 B2 10/2006 Williams et al.
7,127,772 B2 10/2006 Dingert et al.
7,137,169 B2 11/2006 Murphy
7,144,173 B2 12/2006 Policicchio
7,163,349 B2 1/2007 Policicchio
7,182,537 B2 2/2007 Policicchio
7,185,392 B2 3/2007 Murray
7,225,495 B2 6/2007 Berti et al.
7,264,413 B2 9/2007 Vosbikian et al.
7,293,322 B2 11/2007 Matousek
7,313,843 B2 1/2008 Brinker et al.
7,343,638 B2 3/2008 Mitchell et al.
7,350,257 B2 4/2008 McKay
7,380,307 B2 6/2008 Tsai
7,428,768 B2 9/2008 Dingert
7,465,115 B2 12/2008 Suda
7,536,743 B2 5/2009 Goh et al.
7,566,671 B2 7/2009 Hoadley
7,574,768 B2 8/2009 Morris et al.
7,618,206 B2 11/2009 Sacks
7,640,626 B2 1/2010 Oh
7,648,303 B2 1/2010 Zorzo
7,665,180 B2 2/2010 Haan
7,699,551 B2 4/2010 Suda
7,721,381 B2 5/2010 Michelson et al.
7,740,193 B2 6/2010 Soller et al.
7,779,501 B2 8/2010 Lacotta et al.
7,841,039 B1 11/2010 Squire
7,841,040 B2 11/2010 Strunk et al.
7,856,691 B2 12/2010 Viggiani
7,891,047 B2 2/2011 Milanese
7,895,697 B2 3/2011 Cassar
7,930,798 B2 4/2011 Zhou
8,052,342 B2 11/2011 Rosenzweig
8,056,181 B2 11/2011 Kim
8,069,520 B2 12/2011 Mattucci et al.
8,142,094 B2 3/2012 Kaleta
8,166,597 B2 5/2012 Levitt et al.
8,171,592 B2 5/2012 Tsai
8,186,898 B2 5/2012 Bradbury
8,205,288 B2 6/2012 Broman et al.
8,205,293 B2 6/2012 Rosenzweig
8,239,999 B2 8/2012 Hsu
8,245,351 B2 8/2012 Rosenzweig
8,250,700 B2 8/2012 Pung et al.
8,261,402 B2 9/2012 Rosenzweig
8,267,607 B2 9/2012 Harris
8,276,234 B2 10/2012 Hsu
8,286,294 B2 10/2012 Cassar
8,407,848 B2 4/2013 Pung et al.
8,449,682 B2 5/2013 Perelli et al.
8,464,389 B2 6/2013 Jiang et al.
8,464,391 B2 6/2013 Bober et al.
2002/0194693 A1 12/2002 Wu
2003/0028988 A1 2/2003 Streutker et al.
2003/0044569 A1 3/2003 Kacher et al.
2003/0126710 A1 7/2003 Policicchio

(56) References Cited

U.S. PATENT DOCUMENTS

| | | | |
|---|---|---|---|
| 2004/0146332 | A1 | 7/2004 | Fu |
| 2004/0231700 | A1 | 11/2004 | Bell et al. |
| 2007/0130713 | A1 | 6/2007 | Chen et al. |
| 2008/0222825 | A1 | 9/2008 | Sampaio |
| 2009/0235476 | A1 | 9/2009 | Cioci |
| 2009/0249570 | A1 | 10/2009 | Rosenzweig et al. |
| 2010/0199455 | A1 | 8/2010 | Vrdoljak |
| 2011/0167583 | A1 | 7/2011 | Weaver et al. |
| 2011/0185529 | A1 | 8/2011 | Kandasamy et al. |
| 2011/0219581 | A1 | 9/2011 | Vines |
| 2011/0223375 | A1 | 9/2011 | Kaminer |
| 2012/0195674 | A1 | 8/2012 | Mandle et al. |
| 2012/0269567 | A1 | 10/2012 | Crawford et al. |
| 2013/0067673 | A1 | 3/2013 | Yu |

FOREIGN PATENT DOCUMENTS

| | | |
|---|---|---|
| EP | 0430846 | 6/1991 |
| EP | 1985221 | 10/2008 |
| GB | 2276811 | 10/1994 |
| WO | WO9740736 | 11/1997 |

OTHER PUBLICATIONS

Entire patent prosecution history of U.S. Appl. No. 13/833,571, filed Mar. 15, 2013, entitled, "Steam Distribution Apparatus and Methods for Steam Cleaning Devices."
Entire patent prosecution history of U.S. Appl. No. 14/035,431, filed Sep. 24, 2013, entitled, "Flexible Scrubbing Head for a Floor Mop."
Entire patent prosecution history of U.S. Appl. No. 14/035,455, filed Sep. 24, 2013, entitled, "Sliding Scrub Brush for a Floor Mop."
Entire patent prosecution history of U.S. Appl. No. 14/043,346, filed Oct. 1, 2013, entitled, "Floor Mop With Removable Base Plate."
Office Action dated Jan. 16, 2015 for U.S. Appl. No. 13/833,571.
Office Action dated Mar. 10, 2015 for U.S. Appl. No. 14/043,346.
Office Action dated Mar. 11, 2015 for U.S. Appl. No. 14/035,455.
Notice of Allowance dated Jun. 8, 2015 for U.S. Appl. No. 13/833,571.

* cited by examiner 106
118
108
100
104
112
116
114
120
110
102
126
124
122
128

FIG. 6A
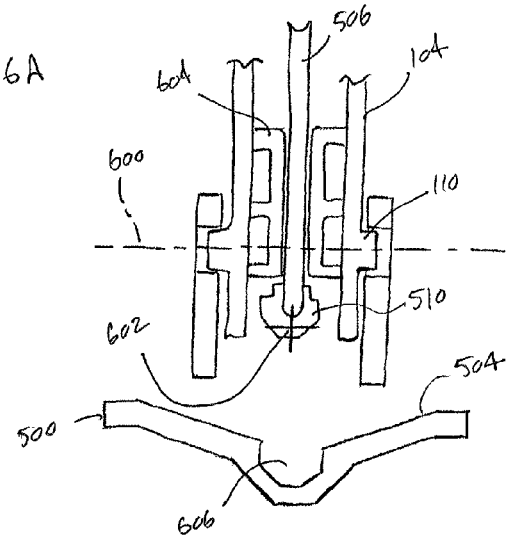
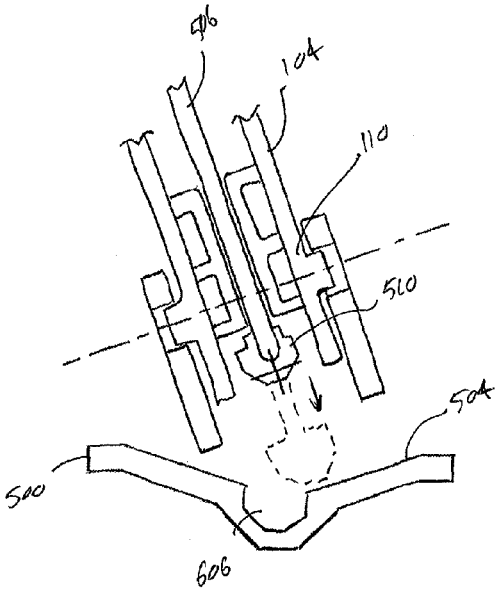
FIG. 6B
FIG. 6C
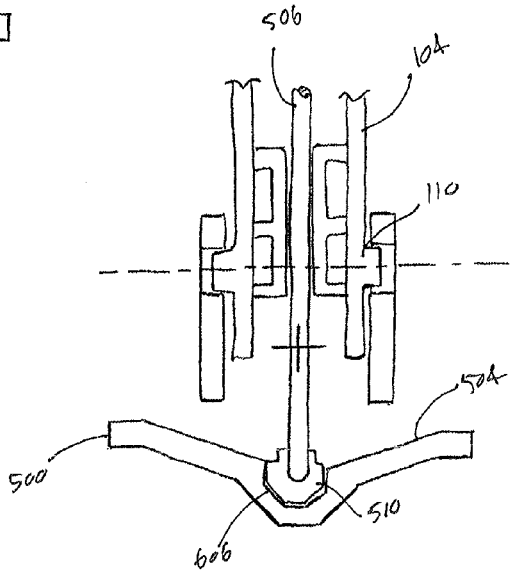

FLOOR MOP WITH CONCENTRATED CLEANING FEATURE

CROSS-REFERENCE TO RELATED APPLICATIONS

The present application is related to U.S. patent application Ser. No. 14/035,431 (entitled "Flexible Scrubbing Head for a Floor Mop") now U.S. Pat. No. 9,554,686; and Ser. No. 14/035,455 (entitled "Sliding Scrub Brush for a Floor Mop"), now abandoned.

FIELD OF THE INVENTION

The present invention relates to floor mops, and more particularly to floor mops having a feature to selectively provide concentrated cleaning force.

BACKGROUND

Spray Mops are simple cleaning tools that have gained favor by consumers following a recent trend in the popularity of hard floor surfaces (e.g., tile, wood, stone, marble, linoleum etc.) within the housing market. Early hard floor cleaning tools typically comprised a string mop, rag mop, or sponge mop that was used in conjunction with a separate bucket of cleaning solution. Such devices are still in use today, and can be effective, but they are often considered cumbersome to use.

The foregoing mopping devices have been replaced in the marketplace with increasing frequency by flat mops having a flat plate mounted to a long handle, with a removable cleaning pad attached to the plate. Such cleaning pads have included traditional woven fabrics (e.g., string or a knit fabric), sponges, nonwoven fabrics made of polymers, wood pulp, or the like, and the like. Woven and sponge mop pads are generally considered to be reusable, whereas nonwoven pads are often considered to be "disposable" because they are difficult or impossible to effectively clean for multiple reuses.

Flat mops may be used with a separate supply of cleaning fluid (water, detergent or the like), but some are equipped as a "spray mop" having a built-in fluid deposition system including a spray nozzle attached either to the plate or the handle, a vessel filled with liquid cleaning fluid, and mechanism to control the flow of cleaning fluid. Such mechanisms have included, among other things, manually- and electrically-operated pumps, and gravity-operated systems controlled by a valve. The spray frequency and duration are controlled by the user using a hand trigger located on or close to the handle grip. Once the vessel is filled with the cleaning solution of choice and the cleaning pad is installed, the user places the plate on the target surface (typically a floor) and energizes the spray system by squeezing the hand trigger or other mechanism to wet the surface. Once the surface is wetted, the user moves the spray mop pad across the wet surface in forward/aft or left/right directions to wick up the cleaning solution and apply a light downward force to transfer the dirt from the floor to the (now wet) pad.

The plate of a flat mop typically has a large surface (e.g., ~400 mm wide×~100 mm deep). The large surface area provided by the plate and underlying pad provides a large cleaning path, which reduces the time required to clean large areas and provides a significant transfer surface to pick up dirt and liquid. However, the force applied by the user is spread across the total area of the pad (e.g., ~40,000 $mm^2$ in the above example), which is good for covering large areas, but hinders the cleaning result and efficiency when attempting to clean stubborn dirt because it is not possible to focus a large cleaning force on strongly-adhering dirt. Ethnographic observations reveal that users of flat mops address stubborn dirt in a variety of ways. Some users apply more cleaning solution (which is potentially wasteful), and others simply endure the many passes required with the cleaning pad (which is time consuming). Other users apply a greater amount of force to the stain using their sock-covered foot or a separate abrasive pad. Still others attempt to apply more force by moving one or both hands lower on the handle. In any event, these approaches are not considered to be true solutions to the problem of cleaning stubborn dirt, because they can be inconvenient and inefficient to the user.

Some existing flat mop designs attempt to address the issue of cleaning stubborn dirt by adding a scrub brush to the mop. For example, U.S. Pat. Nos. 6,892,415 and 7,225,495 and U.S. Publication No. 2012/0195674 (all of which are incorporated herein by reference) show mops having a scrub brush mounted on the head adjacent the sponge or cleaning pad. However, these devices all require the user to flip the mop head to perform the scrubbing operation, which can be an awkward and inconvenient movement. Furthermore, the device in the aforementioned publication uses a pivoting joint between the handle and the plate, which may increase the difficulty of holding the device with the scrub brush facing towards the floor. Other devices, such as the mops shown in U.S. Pat. Nos. 7,779,501 and 8,166,597, have a scrubbing region built into the center of the base plate, which is activating by increasing the downward force on the mop handle. With these devices, it can be difficult or impossible to tell when the scrubbing region is actually moved into contact with the floor, because there is no separate control to operate it. Also, some of these devices sacrifice a portion of the main cleaning pad to make room for the scrubbing region.

There exists a need to provide alternative solutions to the problems of cleaning stubborn dirt using flat mops, spray mops, and the like.

SUMMARY

In one exemplary embodiment, there is provided a mop having a base plate having a generally flat lower surface configured to face a surface to be cleaned and a base plate opening through the lower surface, a handle having a proximal end, a distal end opposite the proximal end, and a handle axis extending form the proximal end to the distal end, and a joint connecting the proximal end of the handle to the base plate. A first grip is connected at the distal end of the handle. A scrubbing mechanism comprising a scrub bar is movably mounted to the base plate and configured to move between an inactive position in which the scrub bar is flush with or above the lower surface of the base plate, and an active position in which the scrub bar extends through the base plate opening to be at least partially below the lower surface of the base plate. A cleaning pad is selectively connectable to the lower surface of the base plate, and movable between a first configuration in which the cleaning pad lies flat on the lower surface when the scrubbing mechanism is in the inactive position, and a second configuration in which at least a portion of the cleaning pad protrudes downwards from the lower surface when the scrubbing mechanism is in the active position.

It will be appreciated that this Summary is not intended to limit the claimed invention in any way.

BRIEF DESCRIPTION OF THE DRAWINGS

A better understanding of the exemplary embodiments may be understood by reference to the attached drawings, in which like reference numbers designate like parts. The drawings are exemplary, and not intended to limit the claims in any way.

FIGS. 6A, 6B, and 6C are cross-sectional views the pivot lock of FIG. 5, shown in different operative positions.

BRIEF DESCRIPTION OF EMBODIMENTS

The inventors have developed new apparatus and methods for cleaning stubborn dirt using a flat mop or spray mop. Non-limiting examples of these apparatus and methods are described below. The following embodiments generally describe the inventions in the context of a spray mop, but it will be readily apparent that these embodiments are also applicable to flat mops that do not have a separate liquid depositing system.

Figure 1:
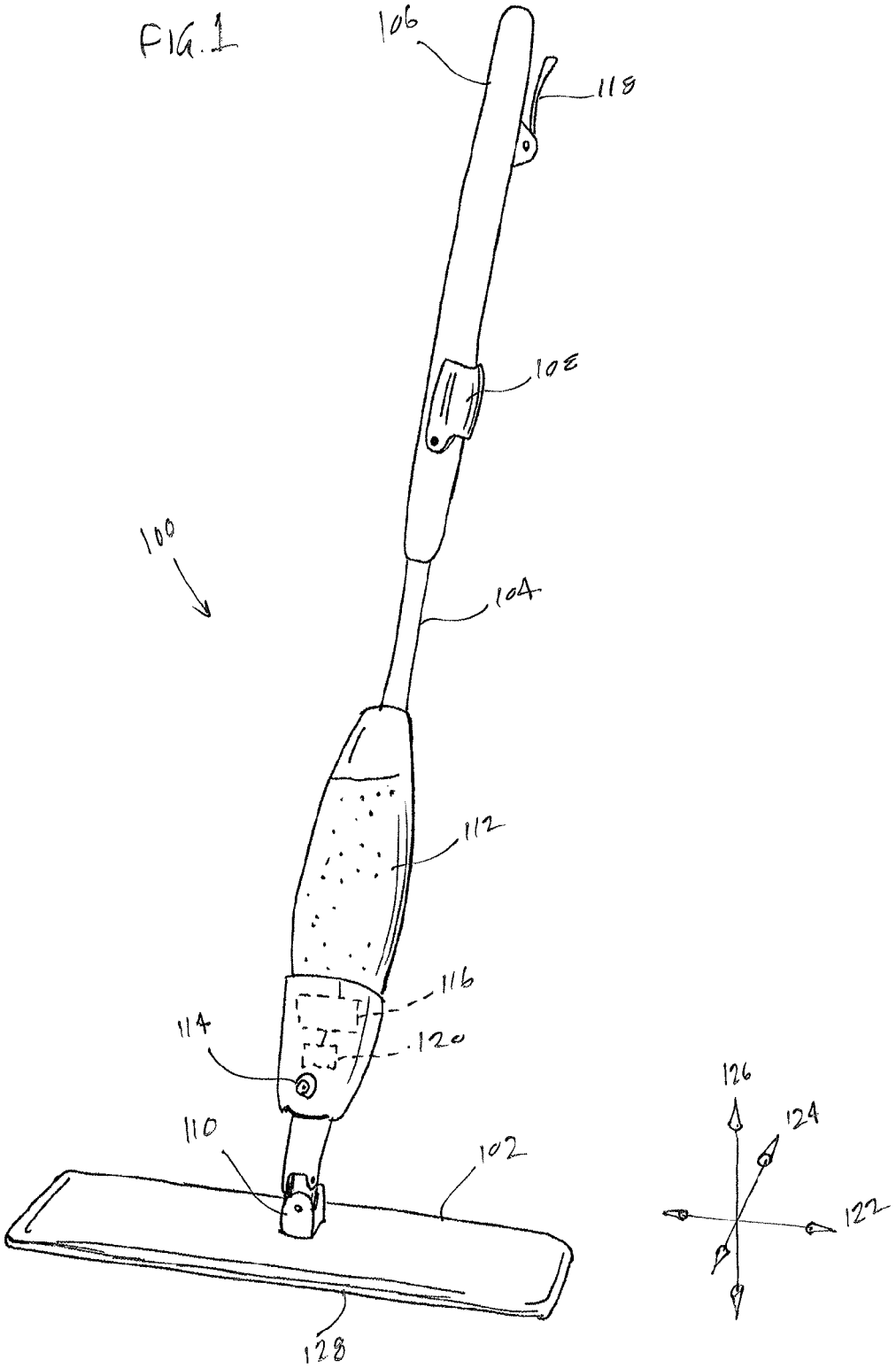
FIG. 1 is a front view of an exemplary embodiment of a spray mop according to aspects of the invention.

FIG. 1 illustrates an exemplary embodiment of a spray mop 100 that is adapted for quick and convenient cleaning of stubborn dirt. As used herein, the term "dirt" is intended to have its broad colloquial meaning, and includes any substance on a surface that is desired to be removed therefrom. This term includes, without limitation, soil, food, liquids, or other substances that are on or adhering to the surface.

The exemplary spray mop 100 includes a base plate 102 to which a handle 104 is attached. The handle 104 is attached at a proximal (lower) end to the base plate 102, and includes first grip 106 at a distal (upper) end, and a grip lever 108 at a location between the proximal and distal ends of the handle 104. The grip 106 and grip lever 108 may be contoured or have gripping material (e.g., overmolded rubber, etc.) to facilitate the user's operation of the mop 100.

The handle 104 is connected to a top side of the base plate 102 via a joint 110. The joint 110 may be a rigid connection, but more preferably is a pivot joint. A pivot joint may be a single-axis pivot that allows the base plate 102 and handle 104 to rotate relative to one another about a single axis, or a multiple-axis pivot that allows the base plate 102 and handle 104 to rotate relative to one another about multiple (e.g., two) axes. Such pivot joints are known in the art, and an example of a suitable pivot joint is shown in U.S. Pat. No. 5,876,141, which is incorporated herein by reference.

The handle 104 may include a fluid deposition system for distributing cleaning fluid (water, detergent, etc.) onto the surface being cleaned. The fluid deposition system includes a tank 112 to hold the cleaning fluid, a sprayer 114 that is positioned and oriented to distribute the fluid in the desired direction, a pump and/or valve assembly 116 to control the fluid flow, and a trigger 118 that is operated by the user to activate the pump/valve assembly 116. The details of such fluid deposition systems are known in the art, and need not be described herein. Examples of suitable fluid deposition systems include, for example, those shown in U.S. Pat. Nos. 5,888,006; 6,659,670; 6,960,042; 6,692,172; 6,722,806; 7,004,658; 7,048,458; 7,160,044; 7,172,099; and 7,850,384, which are incorporated herein by reference. Without excluding other options, the inventors believe that the system shown in U.S. Pat. No. 6,960,042 is expected to be particularly useful to provide simple and effective fluid deposition. In this embodiment, the fluid deposition system comprises a pump 116 that is fluidly connected to the tank 112 to receive the cleaning fluid, and a sprayer 114 that is fluidly connected to the pump 116 to receive pressurized fluid and deposit the fluid onto the surface to be cleaned. Fluid connections may be made by hoses or rigid passages formed in the handle housing. The pump 116 may be a simple plunger pump that is operated by a trigger 118 located at the first grip 106 via a linkage that extends down the length of the handle 104. The tank 112 may be removable for refilling or replacement, or fixed and refilled in place. The foregoing features and variations are well-known in the art, and need not be described herein.

It will be appreciated that various modifications may be made to the foregoing embodiment. For example, the fluid deposition system may be omitted to provide a simple flat mop. As another example, the fluid deposition system may be modified by placing the sprayer 114 or other parts, such as the tank 112, on the base plate 102. As yet another example, a heater 120 may be added in the fluid lines (or to the tank 112) to heat the liquid and/or convert the liquid into steam prior to deposition on the surface being cleaned. As still another example, a vacuum system (i.e., a vacuum suction fan and motor, and associated dirt receptacle), may be added to the mop 100. An example of such a system is shown, in conjunction with an optional steam generator, in U.S. Pat. No. 6,571,421, which is incorporated herein by reference. Other variations and modifications will be apparent to persons of ordinary skill in the art in view of the present disclosure.

The base plate 102 comprises a generally flat base plate lower surface 128 that faces the floor or other surface during use. If desired, the lower surface 128 may have grooves or an arched shape to help distribute forces across the base plate 102, or other features that may be useful to enhance cleaning (e.g., steam outlets). The base plate 102 preferably is elongated in a lateral direction 122, and lies flat in a plane defined by the lateral direction 122 and a longitudinal direction 124 that is perpendicular to the lateral direction. When used on a flat floor or the like, the lateral and longitudinal directions 122, 124 will be perpendicular to a vertical direction 126 defined along the global vertical direction (i.e., the axis of gravitational pull).

Figure 2:
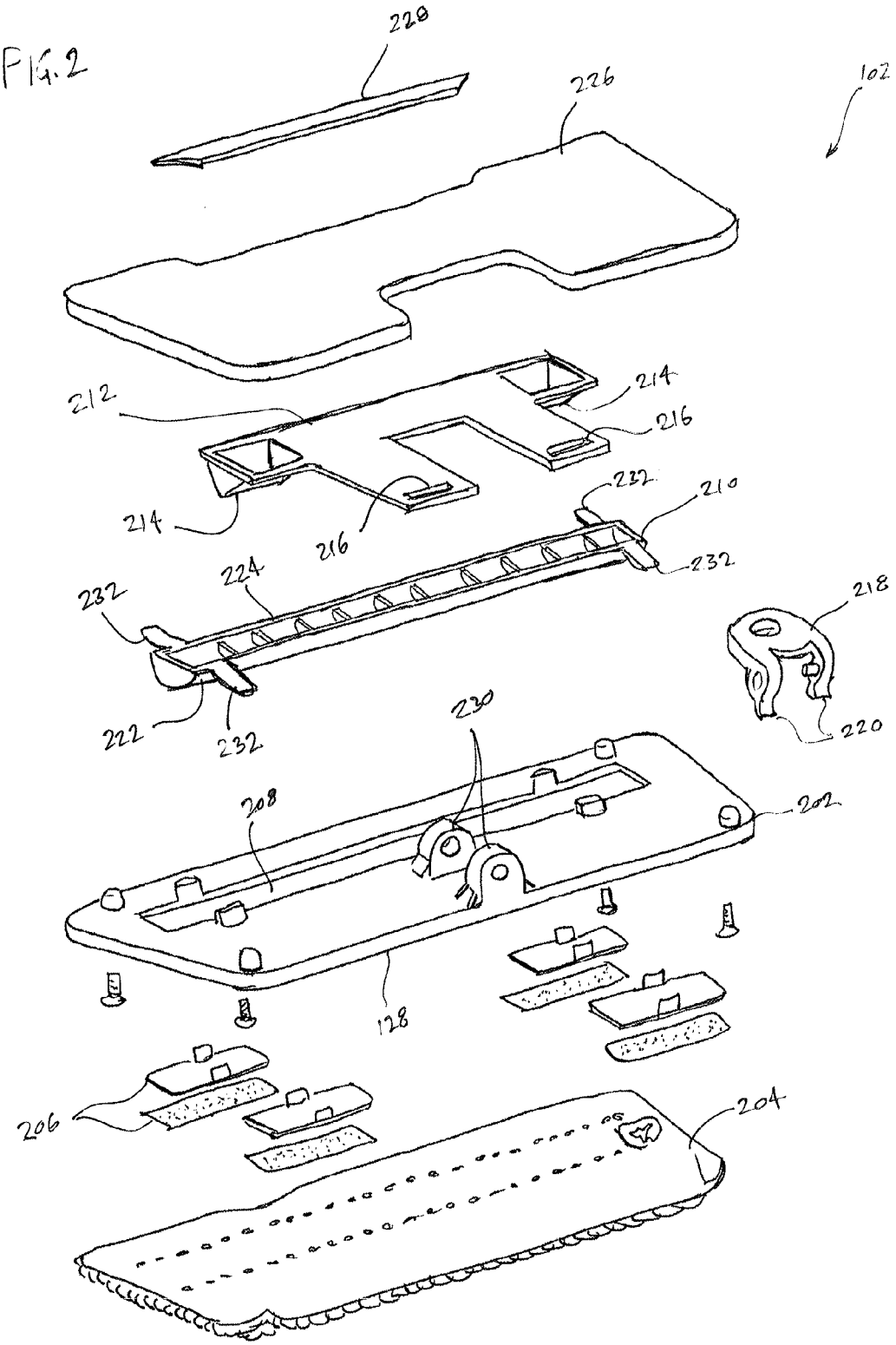
FIG. 2 is an exploded view of a base plate of a spray mop.

The base plate 102 may include an integral cleaning member, such as permanently affixed bristles or the like, but more preferably is equipped with a replaceable cleaning pad 204 (FIG. 2). The replaceable cleaning pad 204 may comprise a nonwoven material, a woven fabric, or any other suitable cleaning medium. The cleaning pad 204 may be connected to the base plate 102 by hook-and-loop fasteners 206, press-in fittings, wrapping portions of the pad 204 around the base plate 102, and so on. Non-limiting examples of pad materials and mechanisms for attaching the pad to the base plate 102 are described in U.S. Pat. Nos. 4,031,673; 6,003,191; 6,305,046; 6,716,805; 6,692,172; 7,350,257; 7,721,381, and 8,464,391, which are incorporated herein by reference. In one exemplary embodiment, the pad 204 comprises a reusable and washable pad comprising one or more woven fabric layers, and the top of the pad 204 and bottom of the base plate 102 have complementary hook-and-loop fasteners 206 that releasably join the two together during use.

Figure 3A:
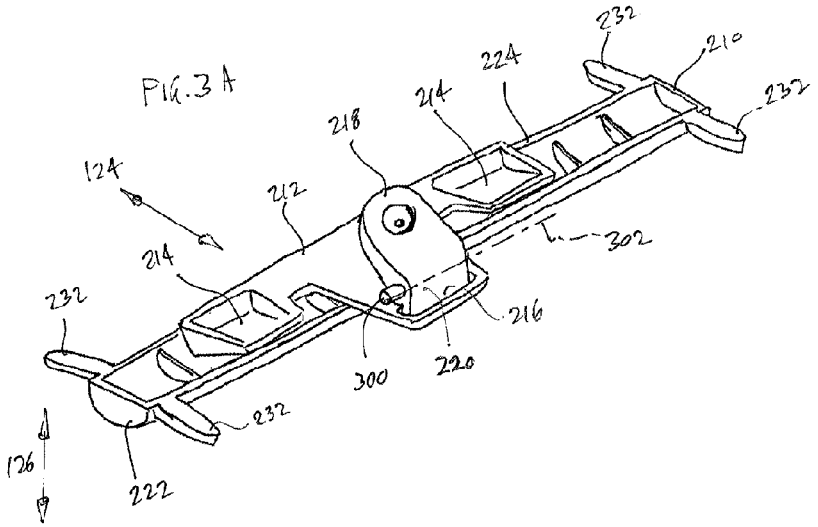
FIG. 3A is an isometric view of portions of a base plate.
Figure 3B:
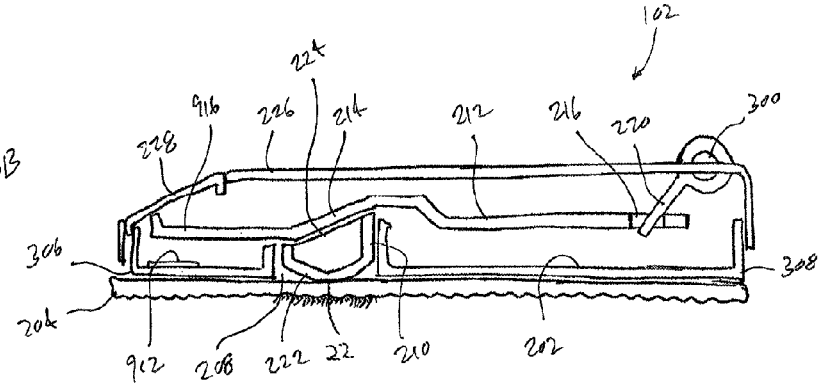
FIGS. 3B and 3C are a cross-sectional side view of a base plate showing them in two different operative positions.

As explained above, a common problem encountered with conventional base plates is that their large surface area inhibits the application of large localized forces to remove stubborn dirt. To address this problem, the base plate 102 preferably can be reconfigured to present a smaller area of contact with the surface being cleaned, to thereby concentrate the forces applied by the user more directly on stubborn dirt. Embodiment of such an apparatus are shown in FIGS. 2, 3A and 3B.

Figure 3C:
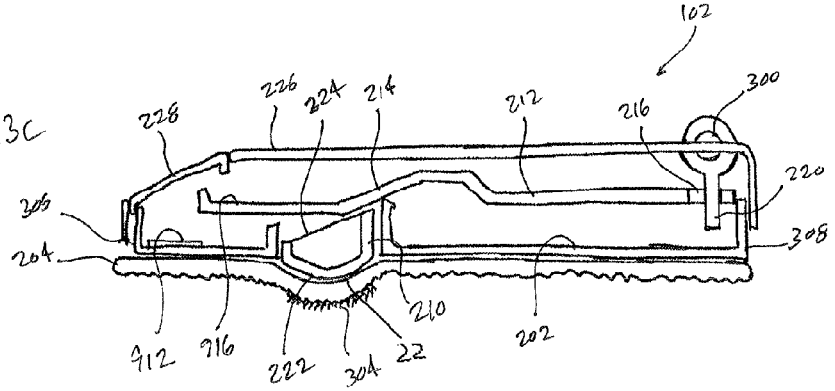

As shown in FIG. 2, the base plate 102 may comprise a main plate 202 that provides a relatively large lower surface that presses on the cleaning pad 204 for normal cleaning operations. The cleaning pad 204 may be attached to the main plate 202, or to other parts of the base plate 102. A scrubbing mechanism 210 is positioned above the main plate 202, with a scrub bar 222 of the scrubbing mechanism 210 configured to fit through an opening 208 in main plate 202. The opening 208 may be entirely within the outer perimeter of the main plate 202, as shown, or it may be a notch formed at one edge of the main plate 202. The scrub bar 222 may have a curved or polygonal cross-section as viewed along the lateral direction 122. For example, the scrub bar 222 may have the shape of a shallow "V" as shown in FIGS. 3B and 3C. Other suitable geometries of the scrub bar 222 that may be useful to enhance cleaning will be understood by one of skill in the art from the description herein. In addition, the scrub bar 222 may comprise multiple individual bars or protrusions, and it may have any width relative to the width of the base plate 102.

A scrubber actuator 212 is positioned above the scrubbing mechanism 210. The scrubber actuator 212 includes one or more ramps 214 that extend downward at an angle towards the main plate 202. The ramps are positioned to interface with a top surface 224 of the scrubbing mechanism 210, as explained below. The scrubber actuator 212 also has slots 216 configured to interface with tabs 220 on a drive lever 218. The drive lever 218 is positioned such that the tabs 220 of the drive lever 218 interface with the slots 216 of scrubber actuator 212. The drive lever 218 may also be positioned below a joint 110 that connects the handle 104 to the base plate 102 to act as a pivot lock, as explained below.

A hood assembly 226 is positioned above the scrubber actuator 212. The hood assembly 226 captures the scrubber actuator 212 in place above main plate 202. The hood assembly may include a transparent window 228. The hood assembly 226 and/or main plate 202 may include other functional features. For example, the main plate 202 may include a connector 230 for the pivot 110, and the hood assembly 226 may provide a pivot mount 300 for the drive lever 218.

FIG. 3A shows how the drive lever 218, scrubber actuator 212 and scrubbing mechanism 210 interface. (The embodiment of FIGS. 3A and 3B has a single tab 220 and slot 216, but is otherwise essentially the same as the embodiment of FIG. 2.) A tab 220 of the drive lever 218 fits through the slot 216 in the scrubber actuator 212. The drive lever 218 rotates about a centerline axis 302 when a force is applied to the drive lever's upper surface. The drive lever's upper surface may include a divot configured to interface with a rod, to act as a pivot lock, as described subsequently herein. The tab 220 swings fore and aft when force is applied to the drive lever's upper surface, causing the scrubber actuator 212 to move fore and aft along a longitudinal axis 124. The scrubber actuator 212 is positioned above the scrubbing mechanism 210 so that the ramps 214 can be moved back and forth over the scrubbing mechanism 210.

The operation of the exemplary base plate 102 is illustrated in FIGS. 3B and 3C. FIG. 3B shows the apparatus in the inactive position, and FIG. 3C shows it in the active position. As shown in FIG. 3B, when the scrubber actuator 212 is in the forward position, the ramps 214 are positioned to allow the scrubbing mechanism 210 to rise up with its scrub bar 222 generally flush with the lower surface of the main plate 202. Springs or other resilient members may be provided to lift the scrubbing mechanism 210 to this position. For example, the scrubbing mechanism 210 may include integrally-formed cantilevered springs 232 that extend from the sides of the scrubbing mechanism 210 and are positioned to press down on the top of the main plate 202. In this embodiment, the springs 232 are deformed when the scrubbing mechanism 210 is moved downwards to generate internal tension to drive the scrubbing mechanism 210 back up when the ramps 214 are moved back to their starting position. Other springs or resilient devices (e.g., coil springs, leaf springs, elastomeric blocks, etc.) may be used in lieu of the cantilevered springs 232. Alternatively, the scrubber actuator 212 may have opposing ramps (not shown) that lift the scrubbing mechanism 210 up when the scrubber actuator 212 is move forward. In this embodiment, springs may be provided to move the scrubber actuator 212 to the inactive position.

When a sufficient force is applied to the drive lever 218, the drive lever 218 rotates on a pivot mount 300, and the tab 220 rotates backwards around axis 302. Interaction between the tab 220 and the slot 216 moves the scrubber actuator 212 backwards along axis 124, which moves the ramp 214 to a second position above the scrubbing mechanism 210. In this position, the ramp interacts with the upper surface 224 of the scrubbing mechanism 210 to move the scrubbing mechanism 210 downward along axis 126. In this position, the bottom of the ramp 214 and the scrubbing mechanism's upper surface 224 may face one another along perpendicular faces or at a shallow angle (i.e., at a small angle relative to the sliding direction of the scrubber actuator 212, such as less than 30°), so that upward forces on the scrubbing mechanism 210 do not force the ramp 214 sideways to move the scrubber actuator 212 into the inactive position and allow the scrubbing mechanism 210 to retract. When the scrubbing mechanism 210 is moved downward, its lower surface 22 extends through the opening 208 and presses against the pad 204, and creates a downward bump 304 in the cleaning pad 204.

To facilitate the foregoing operation, the cleaning pad 204 may comprise a somewhat flexible material that allows the cleaning pad 204 to lie flat on the lower surface of the main plate 202 when the scrubbing mechanism 210 is inactive, and allows at least some of the cleaning pad 204 to protrude away from the main plate's lower surface when the scrubbing mechanism 210 is active. Suitable materials include pliable fabrics and nonwoven materials, and it is expected that a conventional flat mop pad will operate sufficiently. Also, the cleaning pad 204 may include an extendible pocket to receive the scrub bar 222, or it may have a region of elastic material to allow stretching. The cleaning pad 204 also may be mounted to the base plate 102 by flexible connections (e.g., flexible loops that surround the base plate 102) to allow movement between the two configurations. Other variations and modifications will be apparent to persons of ordinary skill in the art in view of the present disclosure.

With the scrubbing mechanism 210 extended as shown in FIG. 3C, the base plate 102 can no longer rest flat on the floor. Rather, the base plate 102 will only be able to contact the underlying surface through the scrub bar 222 of the scrubbing mechanism 210, and possibly the leading edge 306 or trailing edge 308 of the base plate 102 if the base plate 102 is tipped forward or backward. This concentrates the force that is applied through the cleaning pad 204 to the locations immediately below the scrub bar 222 (and leading edge 306 or trailing edge 308 if the base plate 102 is tipped). It is expected that concentrating the cleaning force in this manner will provide enhanced cleaning effectiveness against stubborn and deeply-ingrained dirt. If desired, the cleaning pad 204 may include a region of coarser material below the lower surface, to increase the scrubbing effectiveness even more.

The embodiments described in FIGS. 2-3C are exemplary and not exclusive. Other suitable linkages and mechanisms for activating a scrubbing mechanism 210 in accordance with the invention will be understood by one of skill in the art from the description herein. For example, the direction of movement of the scrubber actuator 212 may be reversed, or the scrubber actuator 212 may be a rotating cam instead of the shown linearly-actuated device. An electrically-controlled scrubber actuator 212, such as a solenoid, motor, or the like, also may be used. As another example, the scrubber actuator 212 may be omitted, and the drive lever 218 may rotate the scrubbing mechanism 210 between an inactive position and an active position. As yet another example, the drive lever 218 may pull directly on the scrubbing mechanism to slide the scrubbing mechanism 210 parallel to the main plate 202, and a fixed ramp protruding down from the hood assembly 226 drives the scrubbing mechanism 210 downward to extend the scrub bar 222 through the opening 208. It will also be appreciated that the drive lever 218 may be replaced by other suitable activating mechanisms. For example, rather than being a pivoting lever, it may comprises a rotating cam. Also, devices for extending and retracting brushes from vacuum cleaner nozzles, such as shown in U.S. Pat. Nos. 4,073,031 and 4,777,696, which are incorporated herein by reference, may be adapted for this purpose. Other variations and modifications will be apparent to persons of ordinary skill in the art in view of the present disclosure.

The scrubbing mechanism 210 may be operated using any suitable mechanism. For example, a foot pedal or similar device may be used. In a more preferred embodiment, however, the scrubbing mechanism 210 is operated by a mechanism mounted on the handle 104, which is expected to provide an ergonomic benefit. An example of a handle-mounted activation mechanism is shown in FIGS. 4A and 4B, and described in detail below.

Figure 4A:
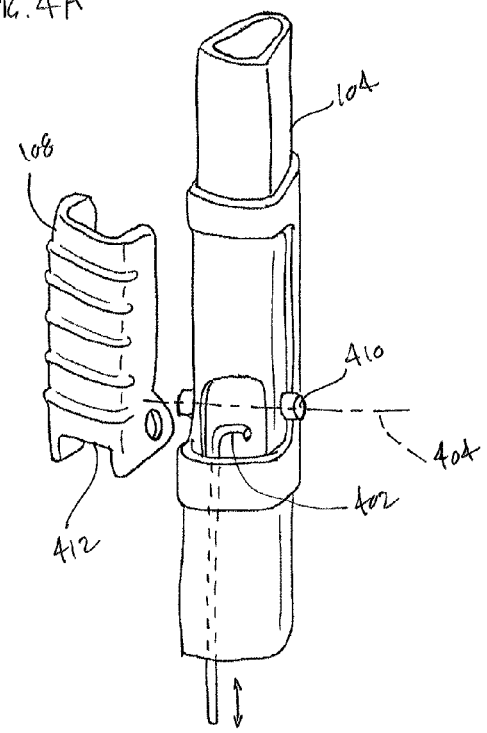
FIG. 4A is an exploded view of an exemplary grip lever mechanism.
Figure 4B:
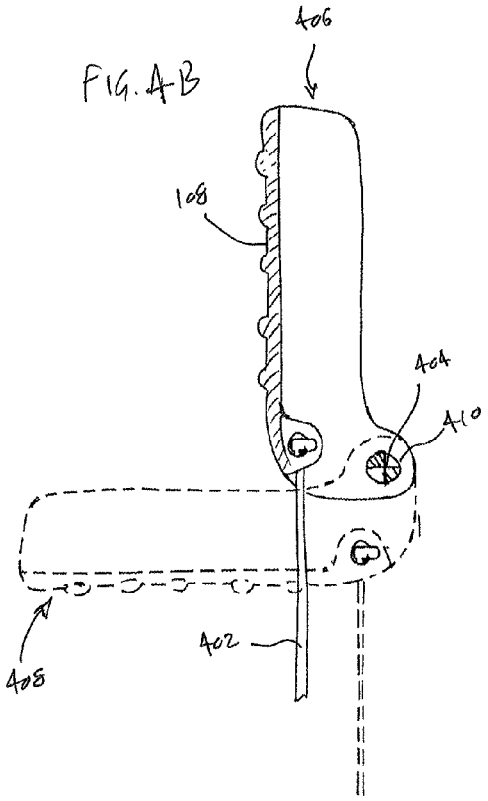
FIG. 4B is a side view of the grip lever of FIG. 4A.

FIGS. 4A and 4B depict an embodiment of a grip lever 108 in accordance with aspects of the invention. The grip lever 108 is connected to the handle 104 by a pivot 410. The grip lever 108 is configured to rotate about an axis 404 from a first position 406 to a second position 408. The grip handle's rotation axis 404 may be generally perpendicular to the longitudinal axis of the handle 104 (i.e., the handle axis extending from the first grip 106 to the joint 110), but other orientations are possible. In the first position 406, the grip lever 108 may be generally parallel with the handle axis and flush with the side of the handle 104. In this embodiment, the grip lever 108 and adjacent region of the handle 104 may be dimensioned to so that a user can grasp the grip lever 108 and handle 104 in one hand to use the grip lever 108 as a grip to hold the handle 104 while the grip lever 108 is flush against the handle 104. In the second position 408, the grip lever 108 preferably is oriented so that it extends at an angle relative to the handle axis, so that the user can grasp the grip lever 108 with the user's palm facing downward to apply a large force to the grip lever 108. In the second position 408 the grip lever may be generally perpendicular (e.g., within about 30° from perpendicular) to the handle axis, to provide a solid hand grip for applying a downward force. In this position, the proximal end 412 of the grip lever 108 (i.e., the end nearest the pivot 410) may abut a corresponding part of the handle 104 or some other kind of travel stop may be provided to stop to the grip lever's rotation about the pivot 410 and transfer forces generated by the user down the length of the handle 104.

An actuator rod 402 positioned inside the handle 104 is interfaced with the grip lever 108 (e.g., by hooking the end of the actuator rod 402 through a hole in the grip lever 108) such that the actuator rod 402 slides downward along the length of the handle 104 when the grip lever 108 is rotated about axis 404 from the first position to the second position. A bottom end of the actuator rod 402 is positioned to press on the drive lever 218 to move it from the inactive position to the active position, to deploy the scrubbing mechanism 210 when the grip lever 108 is moved to the second position. While the shown rod 402 operates as a pushrod, other embodiments may employ the rid 402 as a pull rod or a rotary actuator.

The foregoing embodiment is expected to provide a significant benefit to the operation of a mop 100. In particular, the grip lever 108 can be used to deployed the scrubbing mechanism 210 to perform concentrated cleaning, and the user can press directly on the grip lever 108 to add significantly more downward force to press the base plate 102 into the surface being cleaned. Furthermore, the force generated by the user acts to keep the scrubbing mechanism 210 deployed during cleaning, which may mitigate or eliminate the need to provide a lock or other mechanism to hold the scrubbing mechanism 210 in the active position. This embodiment and others like it are expected to increase cleaning effectiveness, while being simple and intuitive to operate.

In other embodiments, other mechanisms may be provided on the handle 104 to operate the scrubbing mechanism 210. For example, the pivoting grip lever 108 may be replaced by a sliding handle, which may be perpendicular to the handle 104, parallel with the axis of the handle 104, or at angles in between. The grip lever 108 also may be replaced by a mechanism that rotates on an axis that is parallel with the longitudinal axis of the handle 104. Other variations and modifications will be apparent to persons of ordinary skill in the art in view of the present disclosure.

In embodiments of mops that use a pivoting handle 104, the pivoting joint 110 may allow the base plate 102 to contact the underlying surface through the scrubbing mechanism 210 and leading or trailing edge of the plate 102, as explained above. This may be permissible in some embodiments, but other embodiments may include a pivot lock to help the user transmit operating forces more directly through the scrubbing mechanism 210. This may be accomplished by using a non-pivoting joint 110, or by providing a mechanism to fix the orientation of the handle 104 relative the base plate 102 when the scrubbing mechanism 210 is in use. This may be helpful to allow the user to hold the base plate 102 at a fixed angle to the handle 104, so that only the region of the cleaning pad 204 located directly below the scrub bar 222 of the scrubbing mechanism 210 is in contact with the underlying floor.

Figure 5:
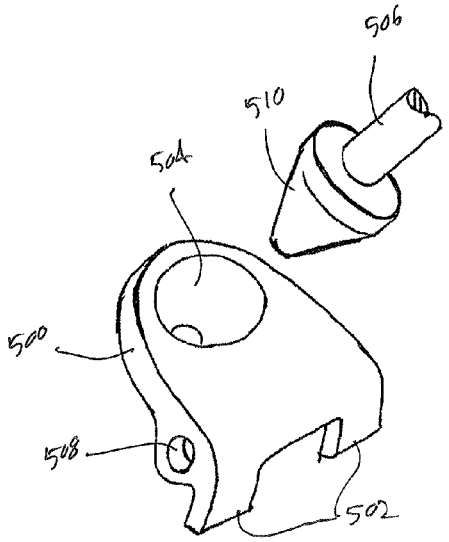
FIG. 5 is an isometric view of an exemplary pivot lock.

FIGS. 5-6C illustrate one exemplary embodiment of a mechanism for locking the base plate 102 position relative to the handle 104. FIG. 5 shows a pivot lock 500 that may also serve as a drive lever 218, such as described above. To this end, the pivot lock 500 includes tabs 502 to operate a scrubbing mechanism 210, and pivot mounts 508 to pivotally connect the pivot lock 500 to the base plate 102.

The upper surface of the pivot lock 500 includes a divot 504 that is used to lock the handle 104 in a fixed orientation relative to the base plate 102. The divot 504 comprises a funnel-shaped depression, which may be conical, hemispherical, or otherwise tapered from a large opening to a smaller end. The divot 504 is configured to mate with a similarly-shaped lower end 510 of a rod 506. The rod 506, may be the actuator rod 402 described above, but may instead be a separate mechanism that the user operates manually when desired. The rod 506 also may be electrically-operated by a solenoid, motor, or the like.

FIGS. 6A, 6B, and 6C are cross-sectional views depicting the alignment of the rod 506 with the divot 504 and the manner in which these parts lock the rotation of the base plate 102 relative the handle 104. As shown in FIG. 6A, the rod 506 passes through the center of a two-axis pivot joint 110. The pivot joint 110 normally is free to rotate about a first axis 600, and a second axis 602 that is perpendicular to the first axis, and perpendicular to the page as shown in FIG. 6A. In this embodiment, the rod 506 is mounted in a bushing 604 that centers the rod 506 within a lower end of the handle 104.

Normal use without the scrubbing mechanism 210 deployed is shown in FIG. 6A. In this position, the rod 506 is positioned above and out of contact with the pivot lock 500. The joint 110 connects the handle 104 with the base plate 102, and permits the handle 104 to rotate along at least one axis with respect to base plate 102. FIG. 6B shows the rod 506 as it is being moved downward through the joint 110 to contact the pivot lock 500. As the rod 506 presses against the pivot lock 500, it rotates the pivot lock 500 to activate the scrubbing mechanism 210 (see FIGS. 3B and 3C). Further pressure on the rod 506 forces the rod 506 further down into the funnel-shaped divot 504, which forces the handle 104 and base plate 102 into a predetermined orientation relative to one another. When the rod 506 reaches the bottom of the divot 504, as shown in FIG. 6C, the base plate 102 and handle 104 will be generally fixed against relative rotation. If desired, the divot 504 may include a pocket 606 at the bottom to more restrictively hold the end of the rod 506, to help hold the base plate 102 and handle 104 in a fixed relationship.

The foregoing embodiment is expected to provide a convenient pivot lock arrangement that is concealed and protected within the joint 110. However, other alternative suitable configurations of pivot locks, divots, and rods will be understood by one of skill in the art from the description herein.

Figure 7A:
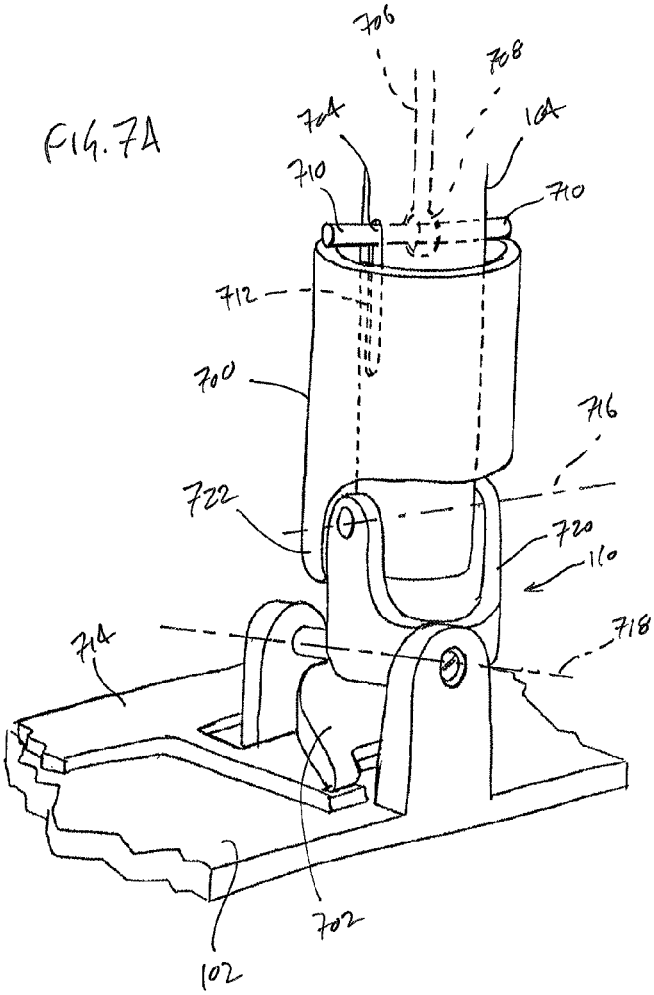
FIGS. 7A and 7B are isometric views of an alternative pivot lock, shown in different operative positions.
Figure 7B:
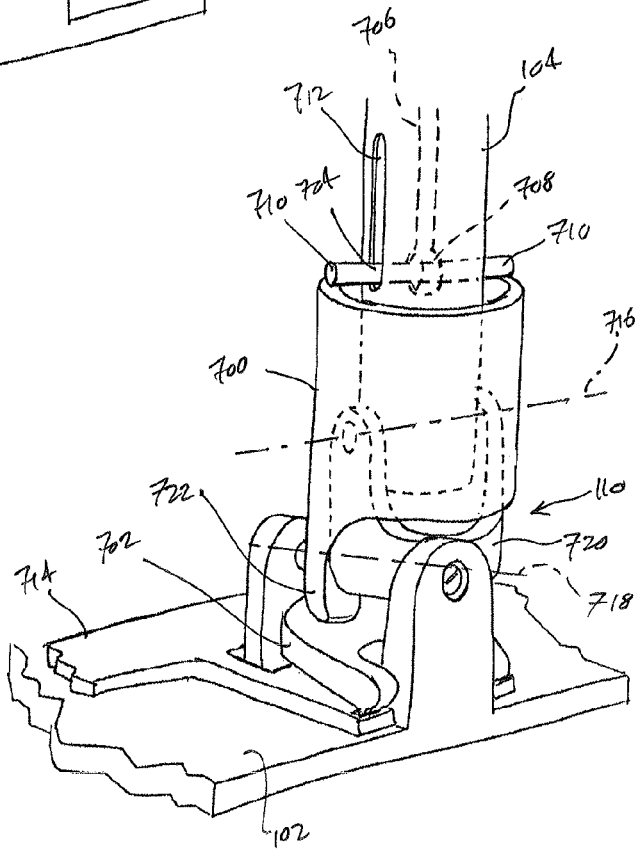

An alternative embodiment or a pivot lock is depicted in FIGS. 7A and 7B. In this embodiment, a sheath 700 is configured to surround some or all of pivoting joint 110 to prevent the pivoting joint 110 from rotating. In this embodiment, the joint 110 again comprises a two-axis joint that is configured to pivot about a first axis 716 and a second axis 718. The sheath 700 is sized to slide up and down on the handle 104, between a first position, shown in FIG. 7A, and a second position, shown in FIG. 7B. In the first position, the sheath 700 is clear of the joint 110, and does not restrict movement of the handle 104 relative to the 44. In the second position, the sheath 700 restricts rotation about at least one of the two axes 716, 718, as explained below.

The sheath 700 is driven downward to the second position by a horizontal bar 704, which is mated to the end 708 of a rod 706 (such as rod 402 or another rod). The ends 710 of the horizontal bar protrude outwards of the handle 104 through respective openings 712, to a position above the top surface of the sheath 700. The rod 706 is configured to move downward upon operation of a suitable controller, such as grip lever 108 as described above. A return spring (not shown) may be provided to bias the sheath 700 back to the first position, or the sheath 700 may be lifted by the horizontal bar 704 by locating the bar 704 in holes on either side of the sheath 700. When the rod 706 is pushed downward, the horizontal bar ends 710 contact the top surface of the sheath 700 and push the sheath 700 downward to the second position. In an alternative embodiment, a user of the spray mop 100 manually pushes the sheath 700 downward without the use of a rod or a grip lever. Other suitable sheaths and mechanisms for moving sheaths downward will be understood by one of skill in the art from the description here.

When the sheath 700 is pushed downward as shown in FIG. 7B, the sheath 700 surrounds at least some of the joint 110. In the shown embodiment, the sheath 700 closely surrounds the lower end of the handle 104, and an intermediate link 720 between the first and second axes 716, 718. In this position, the sheath 700 holds the handle in a fixed orientation with respect to the intermediate link 720, and thereby prevents the handle 104 from rotating about the first axis 716. A protrusion 722 may extend from the sheath 700 downward to contact a drive lever 702, such as the drive lever 218 described above, to move a scrubber actuator 714 to activate the scrubbing mechanism 210 when the sheath 700 reaches the second position.

In the embodiment of FIGS. 7A and 7B, the sheath 700 may be configured to lock the base plate 102 relative to the intermediate link, to thereby prevent rotation about the second axis 718, but this is not required. If the base plate 102 remains unlocked, the protrusion 722 may be rounded to apply a constant force to the drive lever 702 to hold the scrubbing mechanism 210 in the active position as the handle 104 and intermediate link 720 move relative to the base plate 102. Alternatively, the sheath 700 may surround the lower part of the intermediate link 720 and a portion of the base plate 102 to hold them together to fully lock the handle 104 to the base plate 102, or a portion of the sheath 700 (such as the protrusion 722) may fit into a hole on the base plate 102 to hold the base plate 102 relative to the handle 104. Other variations and modifications will be apparent to persons of ordinary skill in the art in view of the present disclosure.

Figure 8:
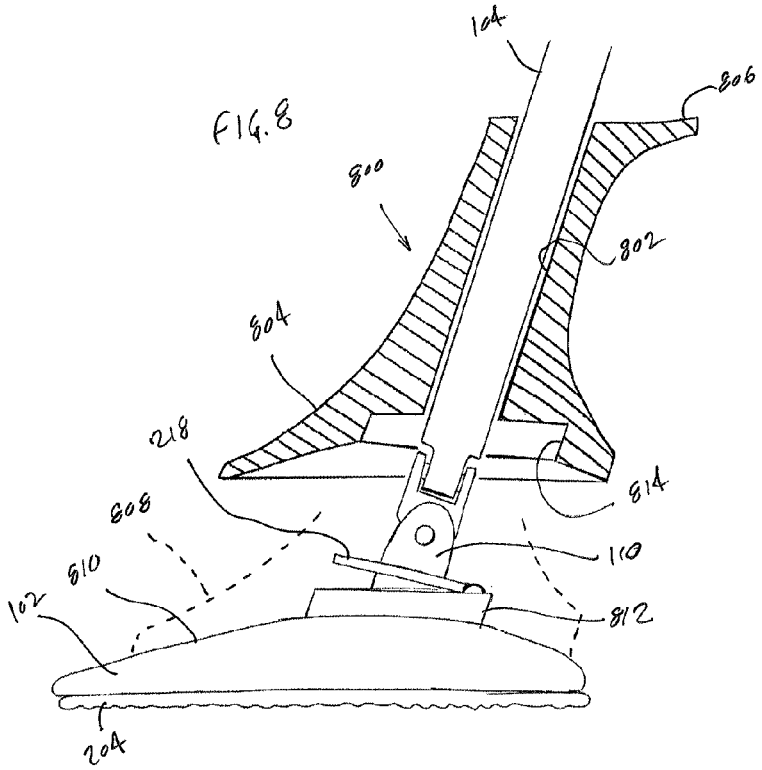
FIG. 8 is a partially cut-away side view of an alternative pivot lock.

FIG. 8 is a partially cut away side view of another pivot lock 800 that may be used in other embodiments. The pivot lock 800 comprises a sheath-like member that surrounds and slides on the handle 104 between an inactive position (shown), and an active position. The pivot lock 800 includes a central bore 802 that fits closely around the handle 104, and a flared-out base 804 that extends from the bottom of the pivot lock 800. The pivot lock 800 may be activated by any suitable mechanism, such as pushrod as described above, a foot pedal 806, or the like.

The central bore 802 is configured to tightly fit around the joint 110 that joins the base plate 102 to the handle 104 when the pivot lock 800 is moved into the active position (shown by broken lines 808). This prevents the base plate 102 from pivoting relative to the handle 104. In addition, the flared-out base 804 of the pivot lock 800 may rest on the upper surface 810 of the base plate 102 to provide a large area of contact to hold the base plate 102 relative to the handle 104. If desired, the base plate 102 and central bore 802 also may have matching locking features, such as a collar 812 and a recess 814, to help hold the parts in unmoving.

Detents or other mechanisms may be used to hold the pivot lock 800 in the inactive and/or active position. A spring also may be provided to bias the pivot lock 800 towards either spring. Other variations and modifications will be apparent to persons of ordinary skill in the art in view of the present disclosure.

The foregoing embodiments incorporate the locking mechanism into the mechanism that activates the scrubbing mechanism 210, which provides a convenience to the operator by simplifying use of the mop 100. It will be appreciated, however, that this is not required in all embodiments. In other embodiments, a separate pivot lock may be used and controlled separately from the mechanism that controls the scrubbing mechanism 210.

Figure 9A:
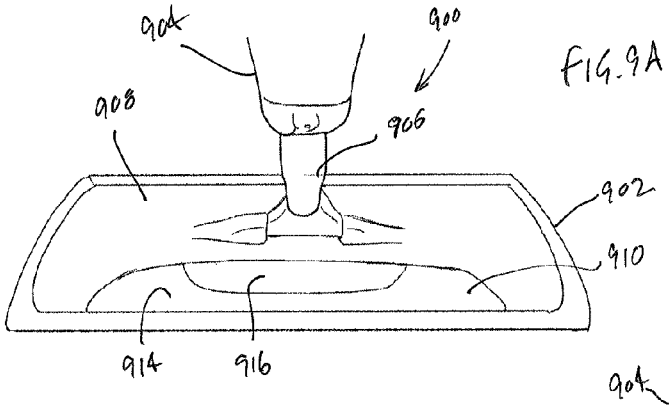
FIGS. 9A and 9B are top views of an exemplary base plate having an operation indicator, shown in different operative positions.
Figure 9B:
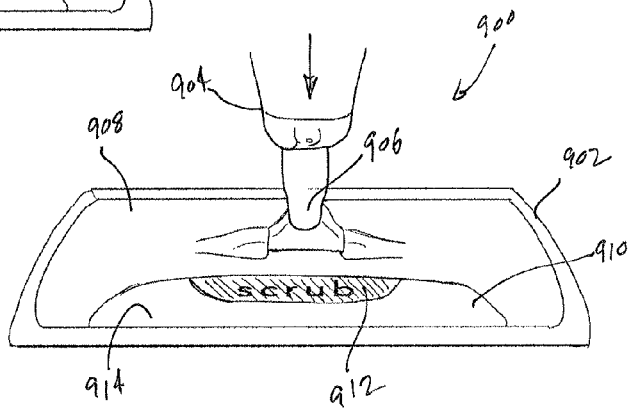

In some embodiments, it may be desirable to include some affirmative indication to the user that the scrubbing mechanism is in the active position. While the position of the grip lever 108 or other activating mechanism should provide this indication, an additional indicator may be used, if desired. One example of an operation indicator is illustrated in FIGS. 9A and 9B, which are top views of a spray mop 900 showing the base plate 902, a portion of the handle 904, and a joint 906 that connects the handle 904 to the base plate 902. The base plate 902, handle 904, and joint 906 may include a rod, a sheath or other mechanism for causing a scrubbing mechanism (not shown) to move downward, as will be understood from the description herein.

In this example, the base plate 902 is similar to the embodiment shown in FIG. 2, and includes a similar arrangement of a sliding scrubber actuator (not shown) to activate and deactivate a scrubbing mechanism (not shown). The base plate 902 includes a hood assembly 908 that covers the top of the base plate 902. The hood assembly 908 includes a window 910 through which a user can view an operation indicator 912 located inside the base plate 902. The operation indicator 912 may comprise a symbolic or written message (e.g., "Scrub Mode Activated" or simply "Scrub"), or a simple color flag or the like. The operation indicator 912 is provided, in this example, as a message and colored background that are printed on the top of a main plate 914 or other surface located below the window 910. The scrubber actuator includes a shroud 916 that covers the operation indicator 912 while the scrubber actuator and scrubbing mechanism are in the inactive position. When the scrubber actuator is moved backwards to activate the scrubbing mechanism, the shroud 916 moves backwards to reveal the operation indicator 912 to the user through the window 910.

Other embodiments may use other kinds of operation indicator. For example, the operation indicator may comprise a light (e.g., a LED or incandescent bulb) that is uncovered or electrically energized when the scrubbing mechanism is in the active position. Any suitable circuitry, such as a microswitch or solid state devices, may be used to activate the light. The operation indicator also may be omitted in other embodiments. Other variations and modifications will be apparent to persons of ordinary skill in the art in view of the present disclosure.

The present disclosure describes a number of new, useful and nonobvious features and/or combinations of features that may be used alone or together. For example, one embodiment of a mop may include a movable scrubbing mechanism that is activated by a grip lever on the handle, which includes a pivot lock and an operation indicator. Another embodiment may use only a movable scrubbing mechanism with or without an operation indicator. Still another embodiment may use a movable scrubbing mechanism that is operated by a mechanism on the handle, but that does not include a pivot lock. Still another embodiment may comprise a foot-operated pivot lock and a movable scrubbing mechanism. Other variations and modifications will be apparent to persons of ordinary skill in the art in view of the present disclosure.

Embodiments of the present invention may be used in conjunction with any suitable mop. For example, features as described above may be integrated into existing mop models, either as new designs, or as a retrofit kit. Other embodiments may be combined with features described in co-pending U.S. patent application Ser. No. 14/035,431 (entitled "Flexible Scrubbing Head for a Floor Mop") now U.S. Pat. No. 9,554,686; and Ser. No. 14/035,455 (entitled "Sliding Scrub Brush for a Floor Mop"), now abandoned.

The embodiments described herein are all exemplary, and are not intended to limit the scope of the inventions. It will be appreciated that the inventions described herein can be modified and adapted in various and equivalent ways, and all such modifications and adaptations are intended to be included in the scope of this disclosure and the appended claims.

I claim:

1. A mop comprising:

a base plate having a generally flat lower surface configured to face a surface to be cleaned and a base plate opening through the lower surface;

a handle having a proximal end, a distal end opposite the proximal end, and a handle axis extending form the proximal end to the distal end;

a joint connecting the proximal end of the handle to the base plate;

a first grip connected at the distal end of the handle;

a scrubbing mechanism comprising a scrub bar having a curved or polygonal cross-section, the scrubbing mechanism being movably mounted to the base plate and configured to move between an inactive position in which the scrub bar is flush with or above the lower surface of the base plate, and an active position in which the scrub bar extends through the base plate opening to be at least partially below the lower surface of the base plate;

a cleaning pad selectively connectable to the lower surface of the base plate, the cleaning pad being movable between a first configuration in which the cleaning pad lies flat on the lower surface when the scrubbing mechanism is in the inactive position, and a second configuration in which at least a portion of the cleaning pad protrudes downwards from the lower surface when the scrubbing mechanism is in the active position; and a base actuator movably mounted to the base plate and operatively associated with the scrubbing mechanism to move the scrubbing mechanism from the inactive position to the active position;

wherein the base actuator comprises a sliding actuator having one or more ramps configured to contact the scrubbing mechanism and move the scrubbing mechanism from the inactive position to the active position upon sliding the sliding actuator relative to the base plate from a first sliding actuator position to a second sliding actuator position;

wherein the base actuator further comprises a drive lever pivotally mounted on the base plate and operatively associated with the sliding actuator to move the sliding actuator from the first sliding actuator position to the second sliding actuator position upon rotating the drive lever from a first drive lever position to a second drive lever position; and wherein the drive lever is operatively associated with the sliding actuator by one or more tabs that extend from the drive lever and engage one or more corresponding slots in the sliding actuator.

2. The mop of claim 1, further comprising one or more springs operatively associated with the scrubbing mechanism and configured to bias the scrubbing mechanism from the active position to the inactive position.

3. The mop of claim 2, wherein the springs comprise cantilevered springs that are integrally formed with the scrubbing mechanism.

4. The mop of claim 1, wherein the handle comprises a handle actuator movably mounted to the handle and operatively associated with the drive lever to move the drive lever from the first drive lever position to the second drive lever position upon moving the handle actuator from a first handle actuator position to a second handle actuator position.

5. The mop of claim 4, wherein the handle actuator further comprises a grip lever mounted to the handle on a grip handle pivot to rotate between a first grip handle position corresponding to the first handle actuator position to a second grip handle position corresponding to the second handle actuator position.

6. The mop of claim 5, wherein the grip handle pivot has a pivot axis that is generally perpendicular to the handle axis.

7. The mop of claim 4, wherein the handle actuator further comprises a rod operatively connected to the grip handle and movable from a first rod position when the grip handle is in the first grip handle position to a second rod position when the grip handle is in the second grip handle position, and wherein the rod contacts and moves the drive lever to the second drive lever position when the rod is in the second rod position.

8. The mop of claim 5, wherein the grip lever is generally parallel to the handle axis when the grip lever is in the first grip handle position, and generally perpendicular to the handle axis when the grip lever is in the second grip handle position.

9. The mop of claim 1, wherein the handle comprises a handle actuator operatively associated with the base actuator and movable to an active handle actuator position in which the handle actuator acts on the base actuator to move the scrubbing mechanism from the inactive position to the active position.

10. The mop of claim 9, wherein the joint comprises a pivoting joint that is configured to allow the base plate to rotate relative to the handle about at least a first axis, and wherein the handle actuator further comprises a rotation lock configured to selectively prevent the base plate from rotating relative to the handle about the first axis when the handle actuator is in the active handle actuator position.

11. The mop of claim 10, wherein the joint is configured to allow the base plate to rotate relative to the handle about a first axis and a second axis.

12. The mop of claim 11, wherein the rotation lock is configured to selectively prevent the base plate from rotating relative to the handle about the first axis and the second axis when the handle actuator is in the active handle actuator position.

13. The mop of claim 10, wherein the handle actuator comprises a rod movable along the length of the handle, the base actuator comprises a drive lever pivotally mounted to the base plate, and the rotation lock comprises an end of the rod that fits into a divot formed on the drive lever.

14. The mop of claim 10, wherein the rotation lock comprises a sheath that is movably mounted on the handle to move to an active lock position in which the sheath surrounds at least a portion of the joint when the handle actuator is in the active handle actuator position.

15. The mop of claim 14, wherein the sheath comprises a flared-out base configured to contact an upper surface of the base plate to help hold the base plate at a fixed orientation relative to the handle when the sheath is in the active lock position.

16. The mop of claim 1, further comprising a fluid deposition system operatively associated with the mop and comprising:

a tank configured to hold a supply of liquid;

a pump fluidly connected to receive the liquid from the tank;

a sprayer fluidly connected to receive the liquid from the pump; and a trigger configured to operate the pump to deposit liquid through the sprayer and onto the surface to be cleaned.

* * * * *